US006488515B2

(12) United States Patent
Sasaki et al.

(10) Patent No.: US 6,488,515 B2
(45) Date of Patent: Dec. 3, 2002

(54) CONNECTOR APPARATUS

(75) Inventors: Harehide Sasaki, Aichi (JP); Keiichi Ito, Aichi (JP); Kazuyuki Shiraki, Aichi (JP); Masanori Wakui, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 09/793,585

(22) Filed: Feb. 27, 2001

(65) Prior Publication Data

US 2001/0019909 A1 Sep. 6, 2001

(30) Foreign Application Priority Data

Mar. 2, 2000 (JP) ..... 2000-057121

(51) Int. Cl.[7] ..... H01R 13/62

(52) U.S. Cl. ..... 439/157; 439/372

(58) Field of Search ..... 439/157, 159, 439/310, 372

(56) References Cited

U.S. PATENT DOCUMENTS 5,919,055 A * 7/1999 Hattori ..... 439/310
5,924,880 A * 7/1999 Watanabe et al. ..... 439/157
6,102,717 A * 8/2000 Aoki et al. ..... 439/157
6,118,668 A * 9/2000 Scholder et al. ..... 439/159

* cited by examiner

*Primary Examiner*—Khiem Nguyen
(74) *Attorney, Agent, or Firm*—Morgan, Lewis & Bockius LLP

(57) ABSTRACT

A projection (9) is provided in a male connector (1). A lever (16) is rotatably provided in a female connector (2). The lever (16) has a curved groove (18). When the lever (16) is turned, the projection (9) is inserted into the groove (18). As the projection (9) is inserted into this groove (18), the connection between the male connector (1) and the female connector (2) is strengthened. At that time, the lever (16) provides leverage. Moreover, the distance between the fulcrum for this lever and a point of action gradually decreases. Furthermore, in this case, the groove (18) is formed in such a way as to extend to the turning center portion of the lever (16), so that the distance between the fulcrum for the lever and the point of action is reduced still more. Consequently, a larger connecting force can be provided thereto.

3 Claims, 7 Drawing Sheets

CONNECTOR APPARATUS

BACKGROUND OF THE INVENTION

1. Technical Field of Invention

The present invention relates to a connector apparatus suitable for use as a multipolar connector.

2. Related Art

Generally, a connector apparatus for use in connecting electric wiring has a problem in which contact frictional resistance between contacts on connection of male and female connectors increases with increase in the number of contacts, so that a large operating force is needed for the connecting operation.

Thus, a multipolar connector having many contacts needs a larger force for performing the connecting operation.

SUMMARY OF THE INVENTION

The invention is accomplished in view of the aforementioned circumstances. Accordingly, an object of the present invention is to provide a connector apparatus enabled to reduce an operating force needed for connection between connectors.

To achieve the foregoing object, according to the invention, there is provided a connector apparatus comprising:

a male connector;

a female connector connectable to the male connector;

an engaging portion provided in one of the male and female connectors;

a lever, rotatably provided in the other connector, having a curved engaged portion, into which the engaging portion is inserted when the lever is rotated, wherein the curved engaged portion is extended to a turning center portion of the lever.

In the above construction, preferably, the curved engaged portion is formed into a part of spiral shape.

In the above construction, preferably, the curved engaged portion is a groove portion, the engaging portion is a projection insertable into the groove portion.

In the above construction, preferably, the engaging portion is on a rotation axis defined as the turning center portion of the lever when the male connector is completely connected to the female connector.

According to this apparatus, when the lever is turned after the male connector is fitted into the female connector until the engaging portion is placed at a curved starting end part of the curved engaged portion, the lever inserts the engaging portion into the curved engaged portion. As the engaging portion advances to the engaged portion, the connection between the male connector and the female connector is strengthened.

At that time, the lever provides leverage. Moreover, the distance between the fulcrum for the lever and a point of action gradually decreases. Thus, as the connection between the male connector and the female connector is strengthened, a large connecting force can be gradually provided thereto without increasing a force to be applied to the lever.

Further, in such a case, particularly, the aforementioned distance between the fulcrum for the lever and the point of action is reduced still more by forming the engaged portion in such a way as to extend to the turning center portion of the lever. Consequently, a larger connecting force can be provided thereto.

DESCRIPTION OF PREFERRED EMBODIMENT

Figure 1A:
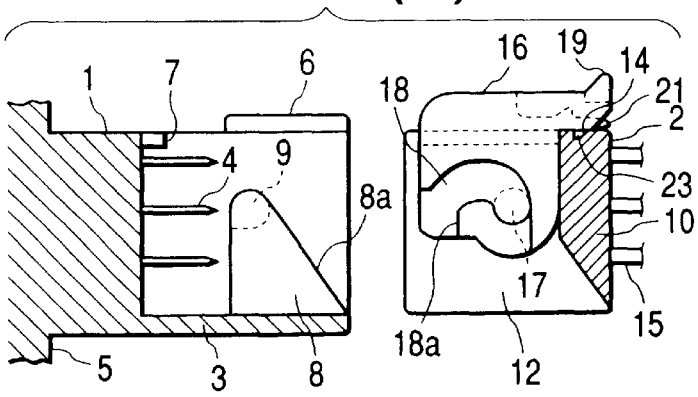
FIGS. 1(A) to 1(F) are longitudinally sectional views each illustrating a male connector and a female connector of an embodiment of the invention at a corresponding one of sequential stages 1(A) to 1(F) of an operation of connecting the connectors.
Figure 2A:
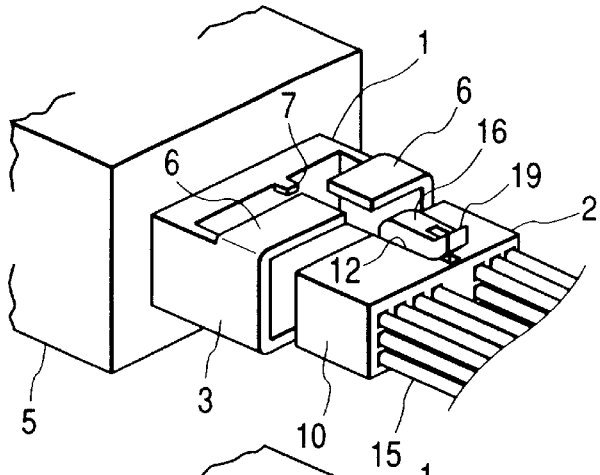
FIGS. 2(A) to 2(D) are perspective views each illustrating the male connector and the female connector at a corresponding one of sequential stages 2(A) to 2(D) of the operation of connecting the connectors.

An embodiment of the present invention is described with reference to the accompanying drawings. Referring first to FIG. 1(A) and FIG. 2(A), there are shown a male connector 1 and a female connector 2, which are in a state in which the connectors 1 and 2 are not connected to each other. The male connector 1 is provided with a housing 3 as an outer shell. Many male contacts 4 are provided in this housing 3.

Particularly, in this case, the housing 3 is formed of an insulating material, such as plastics, in such a way as to be integral with a base portion 5 having an electrically conductive part (not shown) to be connected to the male contacts 4. The housing 3 is shaped nearly like a rectangular box and has an end face that is entirely opened. The top face of this housing 3 is opened except a part of a pair of cover portions 6. The pair of cover portions 6 are respectively provided on opposite sides of the housing 6. The pair of cover portions 6 are placed a predetermined distance apart. A projection portion 7 serving as a latch portion is provided nearly at the center of an innermost edge portion of the opened portion of the top face of this housing and projected therefrom.

Figure 6:
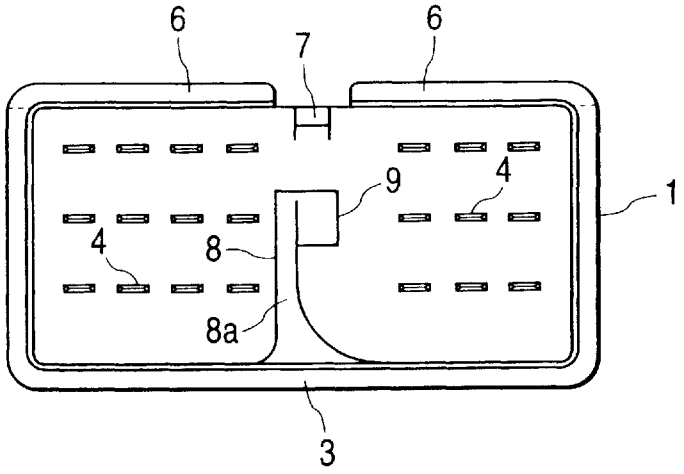
FIG. 6 is a front view illustrating the male connector separately.

As shown in FIG. 6, a support portion 8 is erected on the inner bottom surface of the housing 3. A nearly cylindrical projection 9 serving as the engaging portion is provided on and projected from a side surface (the right side surface as viewed in FIG. 6) of the top end portion of the support portion 8. A gentle slope 8*a* (see FIG. 1) serving as a guide face is formed in a skirt portion of the support portion 8, which faces the open end portion of the housing 3.

The male contacts 4 are made of an electrically conductive material and each shaped like a pin. A base end portion of each of the male contacts 4 is connected to the electrically conductive part of the base portion 5 and provided in such a manner as to project toward the opened portion from the innermost portion of the housing 3.

Figure 7:
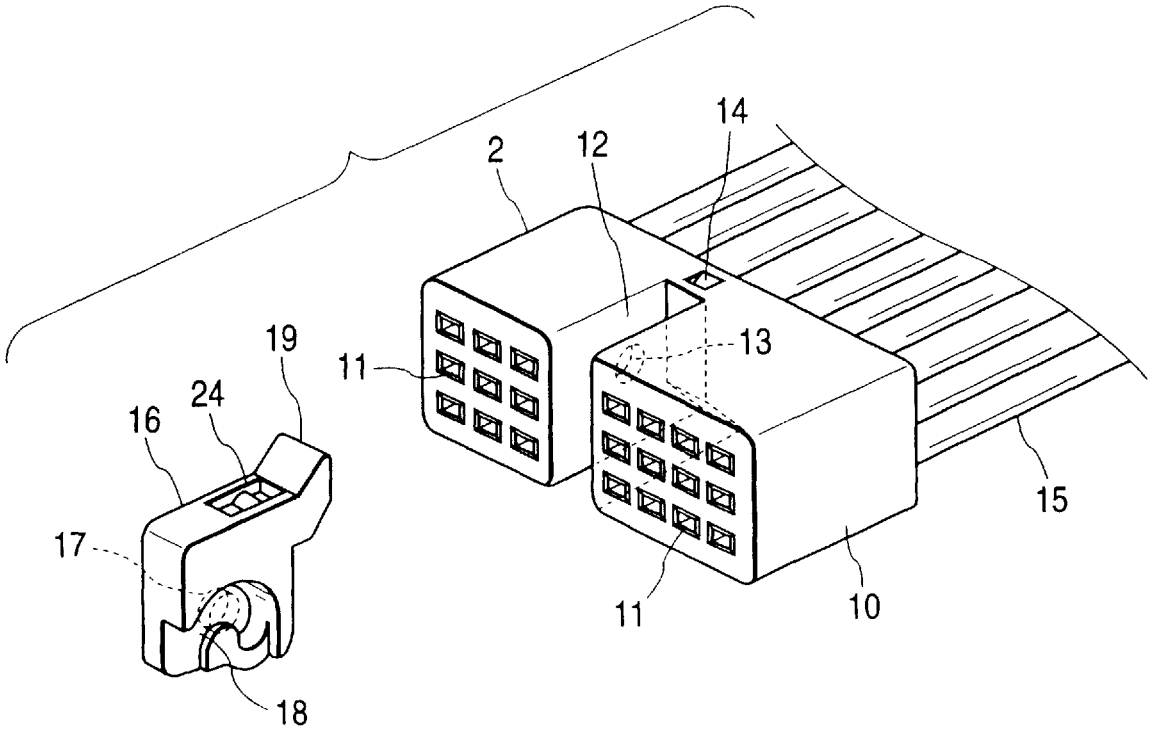
FIG. 7 is an exploded perspective view illustrating the female connector and the lever.

The female connector 2 is provided with a housing 10 as an outer shell. Many female contacts 11 is provided in this housing 10, as illustrated in FIG. 7. Particularly, in this case, the housing 10 is separately formed of an insulating material, such as plastics, and shaped like a rectangular cube having a concave portion 12 in the central part thereof. The front top and bottom faces of the concave portion 12 are opened. A shaft hole 13 is recessed at a side face portion (the right side face portion, as viewed in FIG. 7) of this concave portion 12. Moreover, a small recess portion 14 serving as a latch portion is formed in the top face portion, which is located behind the concave portion 12, of the housing 10.

The female contacts 11 are embedded in both side portions of the housing 10 in such a way as to extend toward the front thereof. Each of the female contacts 11 corresponds to a corresponding one of the male contacts 4 of the male connector 1. Further, lead wires 15 respectively corresponding to the female contacts 11 are backwardly drawn out of the housing 10.

A lever 16 is incorporated into the concave portion 12 of the housing 10. This lever 16 is separately formed of an insulating material, such as plastics, and shaped nearly like a rectangular block. A shaft 17 is formed in a side face (the left side face portion, as viewed in FIG. 7) of the lever 16.

Figure 8:
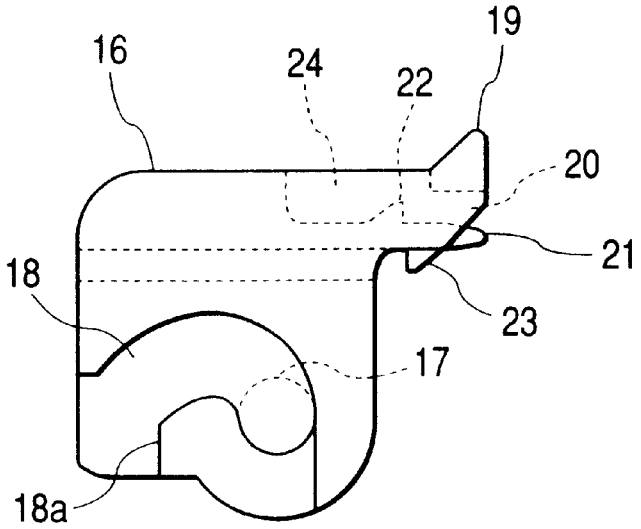
FIG. 8 is a side view illustrating the single lever separately.

A curved groove 18 serving as an engaged portion corresponding to the projection 9 (the engaging portion) of the male connector 1 is formed in the other side face portion (the right side face portion, as viewed in FIG. 7) of this lever 16. As shown in FIG. 8, this groove 18 is shaped like a part of spiral extending backwardly and upwardly from a lower corner on the front side (the left side, as viewed in FIG. 8) of the lever 16 and then turning backwardly and downwardly, so that the innermost end part of the groove 18 and the shaft 17 are arranged side by side. Moreover, the width of the groove 18 is determined in such a way as to be almost equal to (or a little bit larger than) the diameter of the projection 9.

A handhold portion 19 is protruded from a rear end part of the top portion of the lever 16. A hole 20 extending in the frontward and backward directions is formed under the handhold portion 19. An engaging arm 21 extending backwardly (rightwardly, as viewed in this figure) from the inside of this hole 20 is provided in the lever 16. This engaging arm 21 has a front-end portion that is adjacent to the innermost end portion (a front portion) of the hole 20. The use of the front-end portion of the engaging arm 21 as a fulcrum enables the arm 21 to cause upward and downward elastic displacements thereof in the hole 20. Moreover, the engaging arm 21 has a claw 22 serving as the engaged portion, which corresponds to the projection portion 7 (the engaging portion) of the male connector 1, in the top face portion thereof. Furthermore, the engaging arm 21 has another claw 23 serving as a engaged portion corresponding to the small concave portion 14 (another engaging portion) of the female connector 2, which is provided in the bottom face portion thereof.

Figure 9:
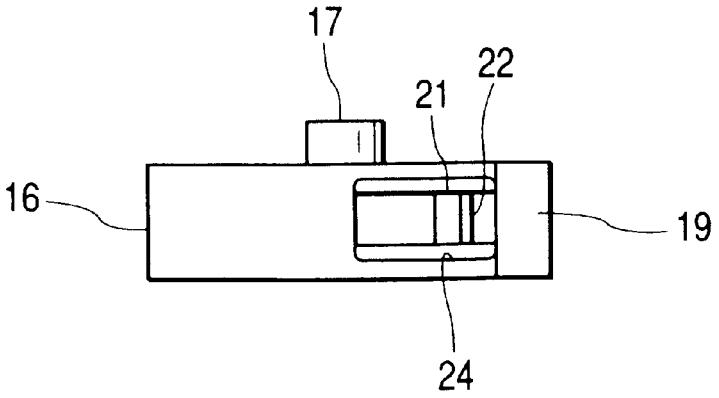
FIG. 9 is a plan view illustrating the single lever separately.

As shown in FIG. 9, a hole 24 is formed in an upper portion of the lever 16 to the handhold portion 19. A die for forming the claw 22 in the top face portion of the engaging arm 21 is drawn out from this hole 24.

With such a configuration, the shaft 17 is fitted into the hole 13. This enables the lever 16, which is incorporated into the concave portion 12 of the housing 10, to rotate around the shaft 17 with respect to the housing 10. The shaft 17 and the innermost end part of the groove 18 are on the rotation axis defined as the turning center portion of the lever 16. That is, the groove 18 is extended to the rotation axis.

Next, an operation of the apparatus of the aforementioned configuration is described hereinafter.

Referring first to FIG. 1(A) and FIG. 2(A), as described above, there are shown the male connector 1 and the female connector 2, which are in a state in which these connectors are not connected to each other. The lever 16 is retained by engaging the claw 23 of the engaging arm 21 with the small concave portion 14 of the female connector 2. So that, the front end portion 18*a* as the entrance of the groove 18 is directed toward the male connector 1.

Figure 1B:
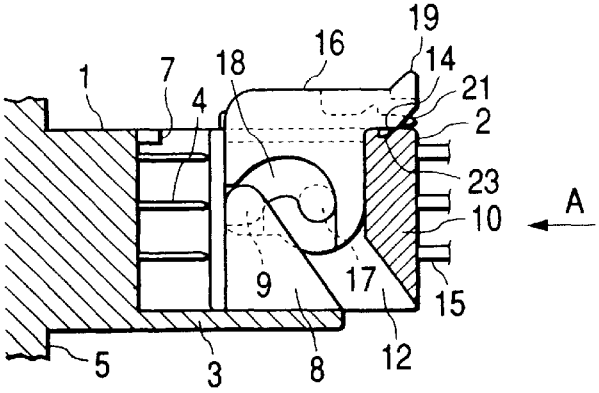
Figure 2B:
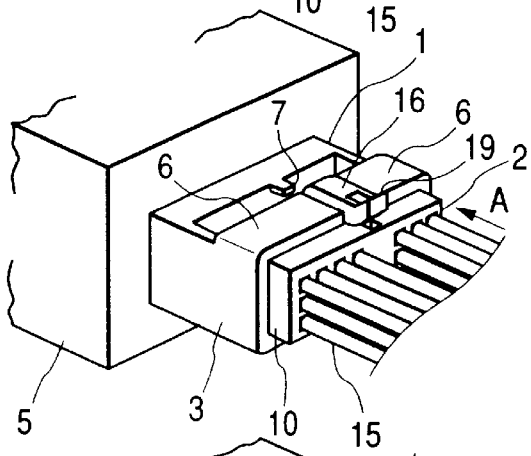

In such a state, subsequently, as illustrated in FIG. 1(B) and FIG. 2(B), the female connector 2 is inserted into the housing 3 of the male connector 1 until the projection 9 reaches the front end portion 18*a* of the groove 18, as indicated by an arrow A. At that time, the lever 16 is placed between the pair of cover portions 6 of the male connector 1.

Figure 1C:
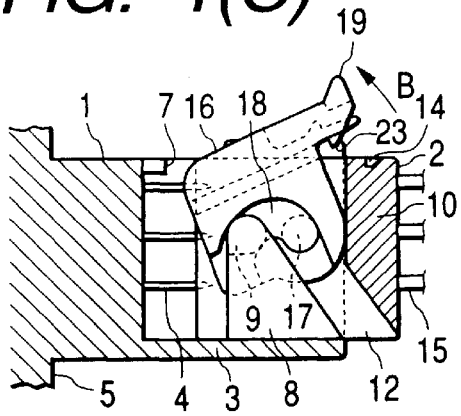
Figure 1D:
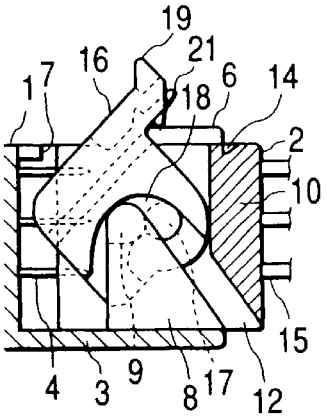
Figure 1E:
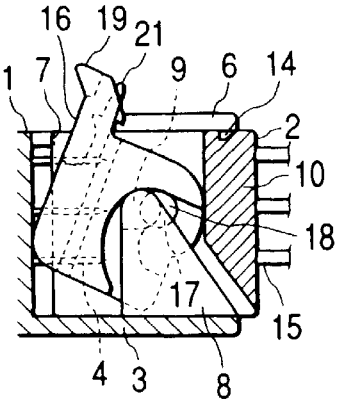
Figure 2C:
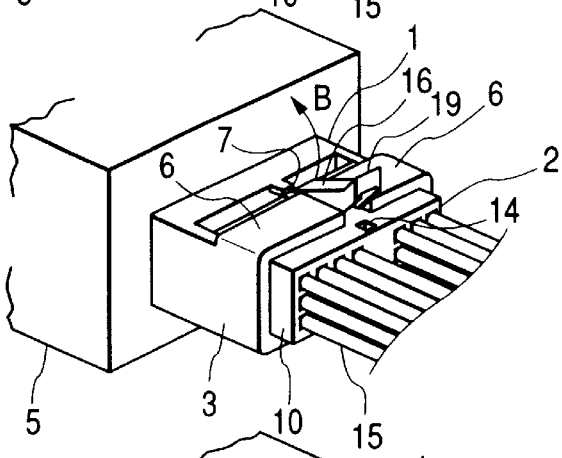

Then, an operator passes the handhold portion 19 of the lever 16 from one hand to the other hand. Subsequently, as illustrated in FIG. 1(C) and FIG. 2(C) , the handhold portion 19 is pushed upwardly, as indicated by an arrow B. Then, the claw 23 of the engaging arm 21 is disengaged from the small concave portion 14 of the female connector 2. Thus, the state, in which the lever 16 is held, is canceled. Moreover, the projection 9 is entered into the groove 18 by counterclockwise turning the lever 16, as viewed in these figures.

Thereafter, during the lever 16 is turned counterclockwise, as viewed in these figures, by pushing the handhold portion 19 of the lever 16 still more, the projection 9 is inserted into the groove 18 more deeply. The groove 18 is shaped like the part of spiral. When the projection 9 is inserted into the groove 18 more deeply, the female connector 2 gradually advances to the innermost end of the housing 3 of the male connector 1. Simultaneously, the connection between the male connector 1 and the female connector 2 is gradually strengthened. Finally, each of the female contacts 11 is fitted into and brought into contact with the corresponding male contact 4.

At that time, the lever 16 provides leverage. Moreover, although the distance between the turning center portion serving as the fulcrum for the lever and the handhold portion 19 serving as a point of application of force is constant, the distance between the turning center portion (that is, the fulcrum) and a contact portion which is in contact with the projection 9 and serves as the point of action gradually decreases. Therefore, the connection between the male connector 1 and the female connector 2 is strengthened. That is, the connecting force between the male and female connectors is gradually increased without increasing the force to be applied to the lever 6 according to the principle of leverage.

Figure 1F:
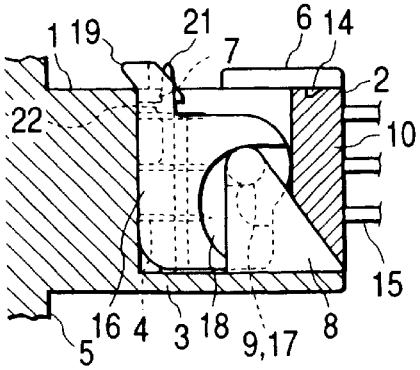

Furthermore, in the case of this configuration, the groove 18 is formed in such a manner as to extend to the turning center portion of the lever 16. Thus, when the lever 16 is counterclockwise turned, as viewed in the figures, by pushing the handhold portion 19 of the lever 16 still more, the lever 16 causes the projection 9 to advance to the turning center portion of the lever 16 (that is, the innermost end portion of the groove 18), as shown in FIG. 1(F). Consequently, the distance between the turning center portion serving as the fulcrum for the lever and the contact portion which is in contact with the projection 9 and serves as the point of action is reduced still more. Thus, a larger connecting force can be provided thereto.

Therefore, even when the apparatus is in circumstances where the contact frictional resistance between the male contacts 4 and the female contacts 11 on connection of the male and female connectors 1 and 2 increases owing to the large number of the contacts 4 and 11, a large operating force is unnecessary for the connection between the male connector 1 and the female connector 2. Consequently, the connecting force needed for the connection therebetween is reduced.

Figure 2D:
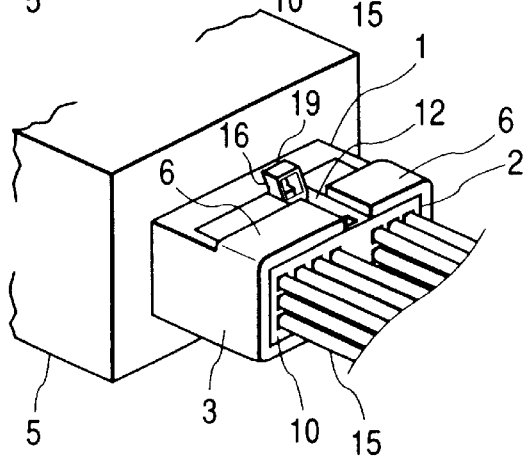

When the projection 9 advances to the turning center portion (that is, the innermost portion of the groove 18) of the lever 16, the lever 16 is held in a connection state in which the female connector 2 is sufficiently connected to the male connector 1 by engaging the projection 7 of the male connector 1 with the claw 22 of the engaging arm 21 (see FIG. 2(D)).

Figure 3:
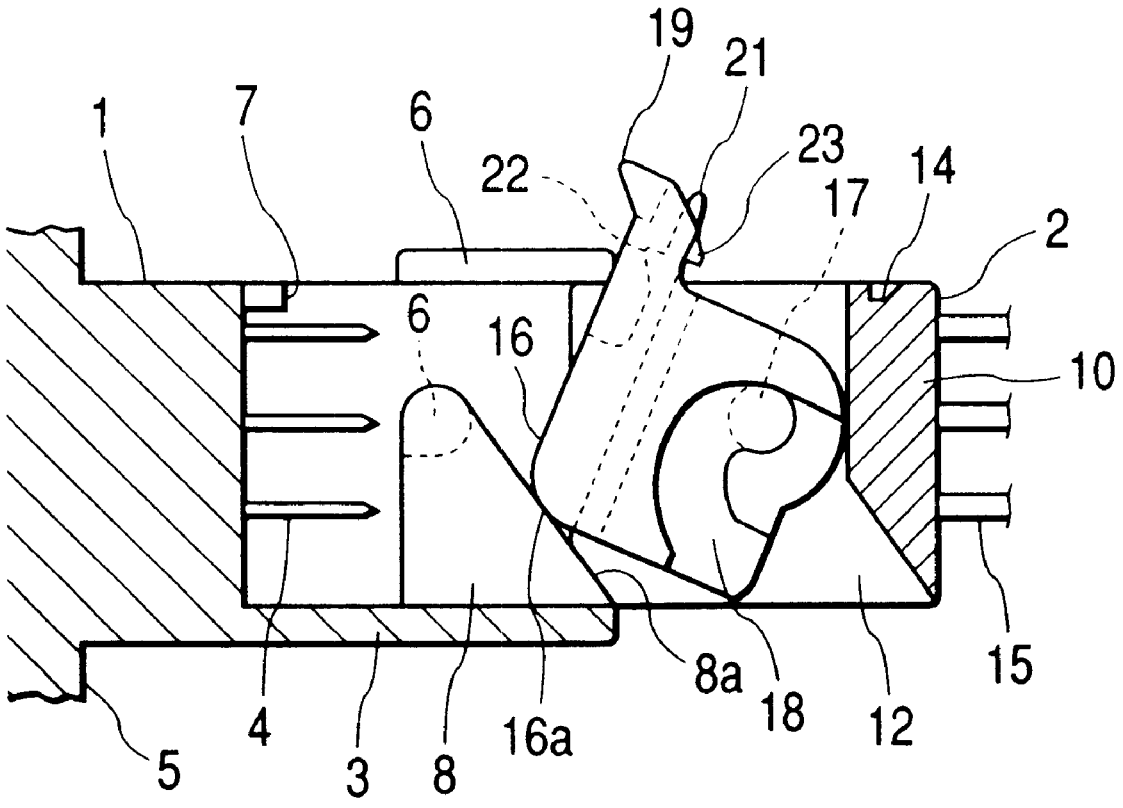
FIG. 3 is a longitudinally sectional view illustrating the male connector and the female connector in the case of performing a connecting operation in a state in which the male connector is insufficiently inserted into the female connector.

In the case that the female connector 2 is insufficiently inserted into the male connector 1 when the connector 2 is first inserted into the connector 1, and the handhold portion 19 of the lever 16 is pushed upwardly (similarly as in the aforementioned case), the lever is turned so that a corner portion 16*a* provided on the front side thereof slide along the slope 8*a* of the support portion as shown in FIG. 3. Consequently, the female connector 2 is returned to a side opposite to the male connector 1. This indicates that the female connector 2 is not connected to the male connector 1. Thus, an operator knows the necessity for starting a connecting operation again.

Figure 4A:
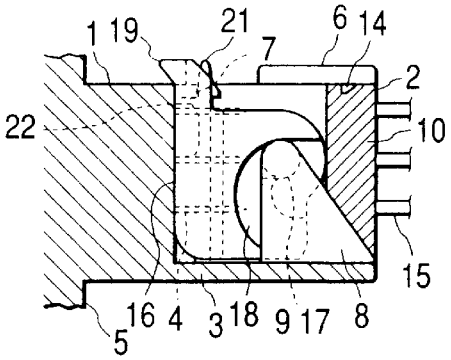
FIGS. 4(A) to 4(E) are longitudinally sectional views each illustrating the male connector and the female connector at a corresponding one of sequential stages 4(A) to 4(E) of an operation of disconnecting the connectors.
Figure 4B:
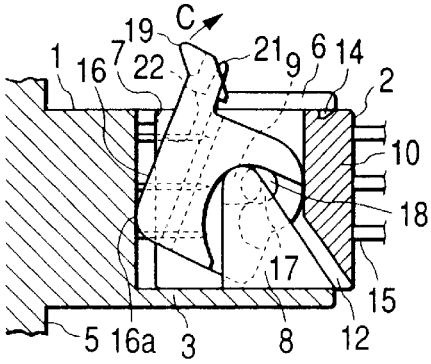
Figure 4C:
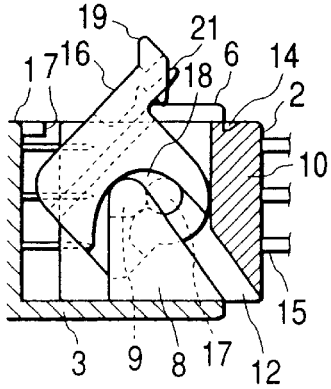
Figure 4D:
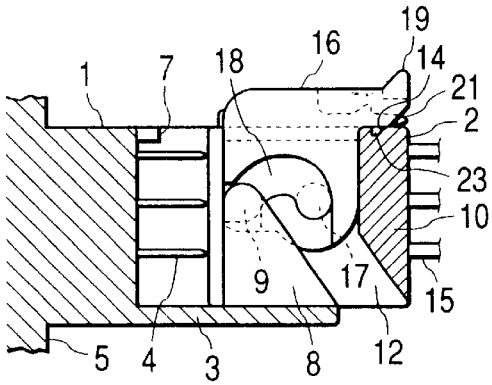
Figure 4E:
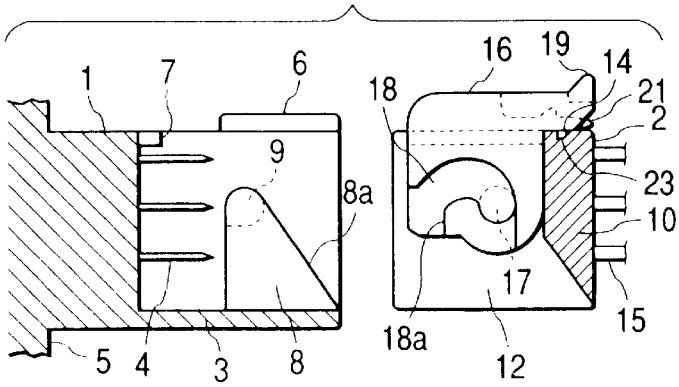
Figure 5A:
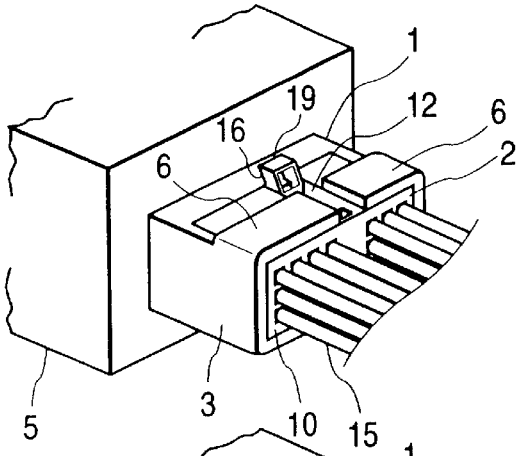
FIGS. 5(A) to 5(D) are perspective views each illustrating the male connector and the female connector at a corresponding one of sequential stages (A) to (D) of the operation of disconnecting the connectors.
Figure 5B:
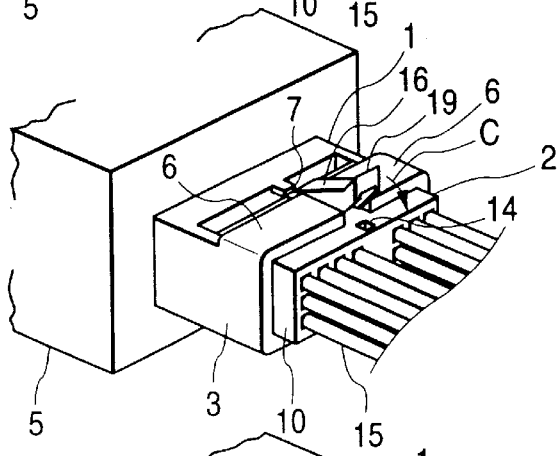

FIGS. 4(A) to 4(E) and FIGS. 5(A) to 5(D) show an operation of disconnecting the connectors. when the handhold portion 19 of the lever 16 in the connection state as shown in FIG. 4(A) and FIG. 5(A) is pulled in a direction indicated by an arrow C, as shown in FIG. 4(B) and FIG. 5(B), the lever 16 is clockwise turned, as viewed in these figures. Thus, the claw 22 of the engaging arm 21 is disengaged from the projection 7 of the male connector 1. Further, at that time, the corner portion 16*a* provided on the front side of the lever 16 is pressure-contacted with the innermost end face of the housing 3 of the male connector 1. Thus, the male connector 2 is made to be apart from the innermost end face of the housing 3. Moreover, the projection 9 is retreated from the innermost portion of the groove 18 (that is, from the turning center portion of the lever 16).

Figure 5C:
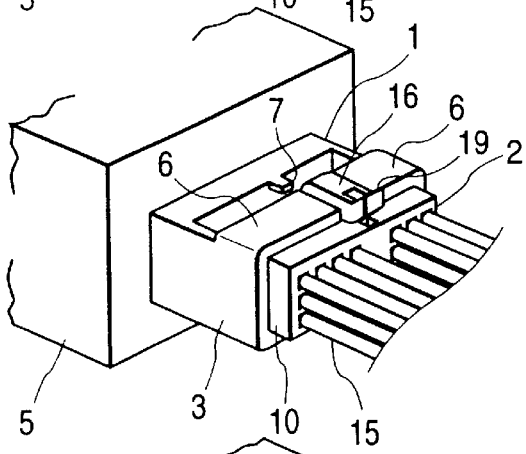

When the lever 16 is clockwise turned still more, as viewed in these figures, by further pulling the handhold portion 19 of the lever 16, the retreat of the projection 9 from the groove 18 is progressed, as illustrated in FIG. 4(C). As described above, the groove 18 is shaped like the part of spiral. Thus, as the retreat of the projection 9 from the groove 18 is progressed, the female connector 2 is gradually drawn out of the housing 3 of the male connector 1, as illustrated in FIG. 4(D) and FIG. 5(C).

Furthermore, the lever 16 clockwise turned, as viewed in the figures, is returned to and held in a state in which the front end portion 18*a* serving as the spiral starting end part of the groove 18 is directed to the front by catching the claw 23 of the engaging arm 21 in the small concave portion 14 of the female connector 2.

Figure 5D:
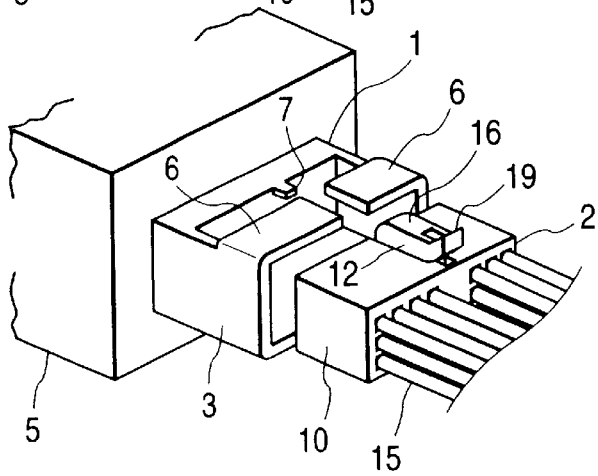

Thereafter, when the female connector 2 is pulled out of the male connector 1, these connectors are completely separated from each other, as illustrated in FIG. 4(E) and FIG. 5(D).

Incidentally, although the projection 9 is provided in the male connector 1 and the lever 16 is provided in the female connector 2 in the aforementioned embodiment, the reverse may be employed. That is, the projection 9 may be provided in the female connector 2, and the lever 16 may be provided in the male connector 1. Further, the relation of projections to depressions between the engaging portion, which is implemented by the projection portion 9, and the engaged portion that is implemented by the groove 18 may be opposite to that in the aforementioned embodiment. That is, the engaging portion may be formed as a depressed portion, while the engaged portion may be formed as a protrusion portion.

Additionally, the present invention is not limited to the embodiment described hereinabove and illustrated in the drawings. The invention can be practiced by being suitably changed without departing from the gist thereof.

As is obvious from the foregoing description, according to the invention, there is provided a connector apparatus having amale connector, and a female connector to be connected thereto. This apparatus comprises an engaging portion provided in one of the male and female connectors, and a lever, rotatably provided in the other connector, having a curved engaged portion, into which the engaging portion is entered when the lever is rotated. In this apparatus, the curved engaged portion is formed in such a manner as to extend to the turning center portion of the lever. Thus, a larger connecting force is provided to the connection between the male connector and the female connector. Therefore, a large operating force is unnecessary for the connection therebetween. Consequently, the operating force for the connection therebetween can be sufficiently reduced.

What is claimed is:

1. A connector apparatus comprising:

a male connector;

a female connector connectable to the male connector;

an engaging portion provided in one of the male and female connectors;

a lever, rotatably provided in the other connector, having a curved engaged portion, into which the engaging portion is inserted when the lever is rotated, wherein the curved engaged portion is extended to a turning center portion of the lever, and wherein the engaging portion is on a rotation axis defined as the turning center portion of the lever when the male connector is completely connected to the female connector.

2. The connector apparatus according to claim 1, wherein the curved engaged portion is formed into a part of spiral shape.

3. The connector apparatus according to claim 1, wherein the curved engaged portion is a groove portion, the engaging portion is a projection insertable into the groove portion.

* * * * *